US006692205B2

(12) United States Patent
Moroi et al.

(10) Patent No.: US 6,692,205 B2
(45) Date of Patent: Feb. 17, 2004

(54) COMPRESSOR INCORPORATED WITH MOTOR AND ITS COOLING JACKET

(75) Inventors: Takahiro Moroi, Kariya (JP); Yoshiyuki Nakane, Kariya (JP); Ryuta Kawaguchi, Kariya (JP); Tsutomu Nasuda, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/199,909

(22) Filed: Jul. 18, 2002

(65) Prior Publication Data

US 2003/0017070 A1 Jan. 23, 2003

(30) Foreign Application Priority Data

Jul. 19, 2001 (JP) ..... P2001-220379

(51) Int. Cl.[7] ..... F04B 17/03
(52) U.S. Cl. ..... 410/410.5; 417/366; 418/83
(58) Field of Search ..... 417/366, 410.5, 417/423.8; 418/83; 62/505

(56) References Cited

U.S. PATENT DOCUMENTS 5,110,264 A * 5/1992 Murry ..... 417/45
6,131,406 A * 10/2000 Barowsky et al. ..... 62/505
6,202,428 B1 * 3/2001 Katayama et al. ..... 62/505
6,287,088 B1 * 9/2001 Nishimura et al. ..... 417/297
6,361,890 B1 * 3/2002 Ban et al. ..... 429/25
2002/0025268 A1 2/2002 Moroi et al. ..... 418/55.1

FOREIGN PATENT DOCUMENTS

| | | | |
|---|---|---|---|
| DE | 3738592 | * | 5/1989 |
| JP | 63-120887 | * | 5/1988 |
| JP | 5-41380 | | 6/1993 |
| JP | 09-201000 | | 7/1997 |

* cited by examiner

*Primary Examiner*—John J. Vrablik
(74) *Attorney, Agent, or Firm*—Morgan & Finnegan, LLP

(57) ABSTRACT

A compressor has a compression unit, a drive motor, a motor housing and an outer cylinder. The compression unit compresses fluid. The drive motor drives the compression unit. The motor housing surrounds the drive motor. The outer cylinder is mounted on an outer circumferential side of the motor housing for defining a cooling jacket between the outer cylinder and the motor housing for cooling the drive motor by a fluid flowing in the cooling jacket. The outer cylinder is indirectly fixed to the motor housing by press-fitting.

18 Claims, 7 Drawing Sheets

(IN THE CASE THAT AN OUTER HOUSING IS FIXED BY ONE BOLT)

(IN THE CASE THAT AN OUTER HOUSING IS FIXED BY FOUR BOLTS)

(IN THE CASE THAT AN OUTER HOUSING IS FIXED BY ONE BOLT)

(IN THE CASE THAT AN OUTER HOUSING IS FIXED BY ONE BOLT)

(IN THE CASE THAT AN OUTER HOUSING IS FIXED BY FOUR BOLTS)

(IN THE CASE THAT AN OUTER HOUSING IS FIXED BY FOUR BOLTS)

(IN THE CASE THAT AN OUTER HOUSING IS FIXED BY ONE BOLT)

(IN THE CASE THAT AN OUTER HOUSING IS FIXED BY FOUR BOLTS)

COMPRESSOR INCORPORATED WITH MOTOR AND ITS COOLING JACKET

BACKGROUND OF THE INVENTION

The present invention relates to a compressor that is driven by a drive motor provided with a cooling jacket thereby reducing vibration and noise upon the compressor being run.

Various compressors are widely applied to air conditioners for domestic and vehicle use. In recent years, a compressor for use in a fuel cell system has been flourishingly developed so as to supply an electrode of a (hydrogen-oxygen type) fuel cell with compressed gas (one of hydrogen, oxygen and air) in order to reduce environmental problems. As a typical example of such a compressor, a scroll type compressor, which is compact and highly efficient, are proposed. The scroll type compressor is normally constituted of a fixed scroll member, a movable scroll member and a drive motor. The fixed scroll member is fixed to a housing. The movable scroll member is arranged so as to face the fixed scroll member. The drive motor drives the movable scroll member. A compression region is defined between the fixed scroll member and the movable scroll member. Gas in the compression region is moved from an inlet formed on the outer periphery of the fixed scroll member toward an outlet formed at the center of the fixed scroll member by orbiting the movable scroll member around an axis of the fixed scroll member while reducing its volume. Thus, the gas is introduced into the compression region, compressed therein and discharged therefrom repeatedly.

Any types of compressors are required to be not only compact and lightweight but also relatively highly efficient for producing relatively enough discharge capacity. Therefore, the drive motor is required to drive the compressor even under the conditions of relatively high load and relatively high rotational speed. When the drive motor is used under such a condition, a relatively large amount of heat such as Joule heat and iron loss is generated. The heat causes the damage of the drive motor, thereby reducing the lifetime of the drive motor. For this reason, the effective radiation of the heat is required. If the inside of the drive motor is opened to the outside thereof, the inside of the drive motor can be cooled down by the air. However, under the substantially airtight condition of the inside of the drive motor, the drive motor is required to be frequently cooled down by water. Therefore, a water jacket is normally arranged on the side of the outer circumference of a motor housing so as to surround the drive motor, thereby cooling the drive motor with water.

Japanese Unexamined Utility Model Publication No. 5-41380 discloses this type of water jacket. In the constitution, a recess as a cooling channel of a water jacket is formed on the side of the outer circumference of a motor housing. The recess is tightly covered with a flexible thin plate. Thereby, the water jacket is formed integrally with the motor housing.

However, such a winding water jacket tends to increase the number of parts and a space for installing the parts or a process for installing the parts. In place of the winding water jacket, a new cooling jacket will be proposed. That is, a refrigerant passage as a cooling channel is formed by closing the recess formed on the outer circumference of the motor housing with an outer cylinder.

In this case, since the outer cylinder is used for closing the recess, a fastener and a seal for connecting one end of the plate in the circumferential direction of the winding water jacket to the other end thereof can be omitted. Therefore, a space for installing the fastener can also be omitted. In addition, the outer cylinder is easily mounted on the motor housing since the outer cylinder is simply fitted around the motor housing. Thus, the cooling jacket such as the water jacket that has a relatively small number of parts and that is compact and easy to mount is obtained. In the present embodiment, the recess formed on the outer circumference of the motor housing constitutes a refrigerant passage.

Even though the water jacket has such a structure, a seal such as an O-ring is required to interpose between the motor housing and the outer cylinder. Such a seal may sufficiently prevent water from leaking.

However, only the seal cannot sufficiently restrict rotation and movement in the axial direction of the outer cylinder. For this reason, the motor housing is required to restrict the outer cylinder by fastening at least one fixture such as a bolt or by press-fitting the motor housing into the outer cylinder. In a sense, the outer cylinder is sufficiently fixed to the motor housing even by one bolt only if the motor housing restricts the outer cylinder.

In a state that a compressor having the outer cylinder fixed by one bolt is run, when vibration and noise are measured and analyzed, however, it is confirmed that the vibration and noise increase more than those of a state that a compressor having the outer cylinder fixed by a plurality of bolts is run. Such vibration and noise make drivers uncomfortable. Therefore, reinforcement is required. In a case that an oscillating source and a sound source do not exist around the circumstances, especially when a compressor for use in a fuel cell system in an electric car is employed, the vibration and noise of the compressor are noticeable.

SUMMARY OF THE INVENTION

The present invention addresses a compressor that can reduce vibration and noise when a cooling jacket for cooling a drive motor is constituted of a motor housing and an outer cylinder.

According to the present invention, a compressor has a compression unit, a drive motor, a motor housing and an outer cylinder. The compression unit compresses fluid. The drive motor drives the compression unit. The motor housing surrounds the drive motor. The outer cylinder is mounted on an outer circumferential side of the motor housing for defining a cooling jacket between the outer cylinder and the motor housing for cooling the drive motor by a refrigerant flowing in the cooling jacket. The outer cylinder is directly or indirectly fixed to the motor housing by fastening a plurality of bolts or by press-fitting.

Furthermore, according to the present invention, the following features are obtained. A scroll type compressor has a motor housing, a drive motor, a center housing, a fixed scroll member, a movable scroll member and an outer cylinder. The drive motor is surrounded by the motor housing. The center housing is fixed to the motor housing. The fixed scroll member is fixed to the center housing. The movable scroll member is placed between the center housing and the fixed scroll member while engaging with the fixed scroll member. The movable scroll member is driven by the drive motor for compressing fluid between the fixed scroll member and the movable scroll member. An outer cylinder is mounted on an outer circumferential side of the motor housing for defining a cooling jacket between the outer cylinder and the motor housing for cooling the drive motor by a refrigerant flowing in the cooling jacket. The outer cylinder is fixed to the center housing by fastening a plurality of bolts or by press-fitting.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A compressor according to a preferred embodiment of the present invention will now be described hereinafter.

Figure 1:
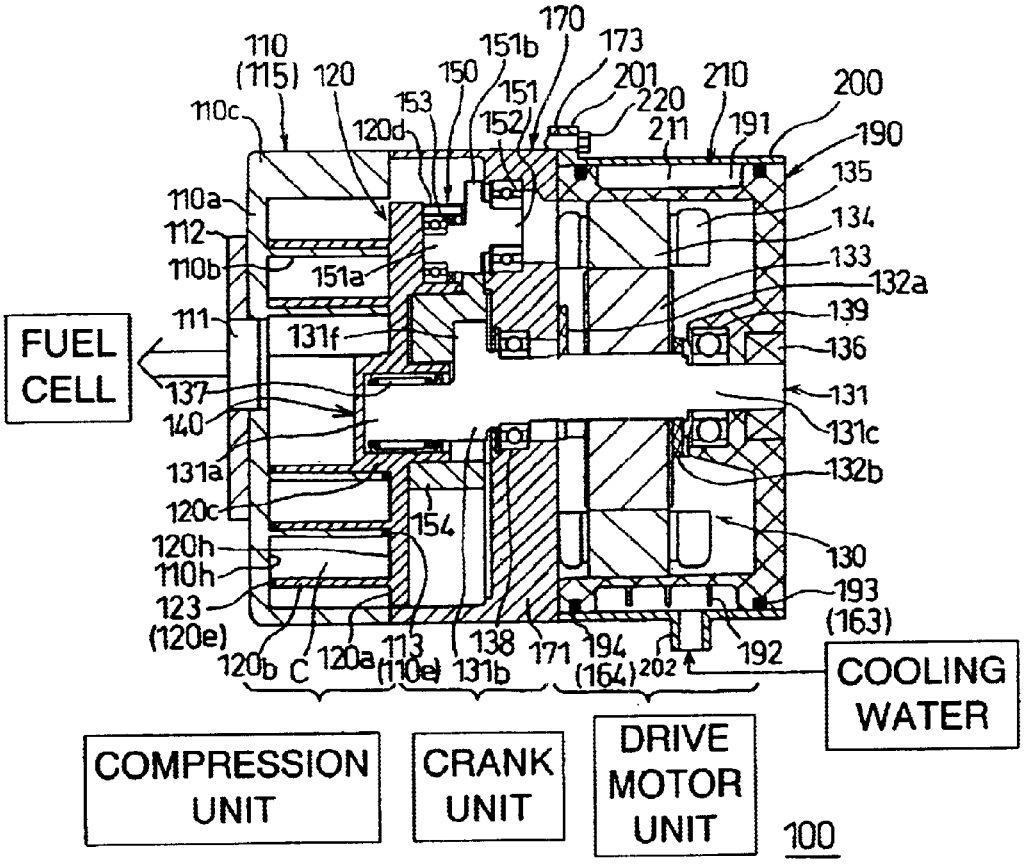
FIG. 1 is a cross-sectional view illustrating a scroll type air compressor for use in a fuel cell according to a preferred embodiment of the present invention.

To begin with, a total structure of the compressor will be explained. A cross-sectional view of a scroll type air compressor 100 (hereinafter a compressor 100) for use in a fuel cell system according to the preferred embodiment of the present invention is shown in FIG. 1. In the drawing, the left side of the compressor 100 is front and the right side of the compressor 100 is rear. The compressor 100 is mainly constituted of a compression unit, a crank unit and a drive motor unit. The compression unit, the crank unit and the drive motor unit are each explained as follows.

The compression unit is constituted of a fixed scroll member 110 and a movable scroll member 120. The fixed scroll member 110 has a disk-like fixed scroll base plate 110*a*, a fixed scroll spiral wall 110*b* that extends from the fixed scroll base plate 110*a*, and an outer circumferential wall 110*c* that surrounds the fixed scroll spiral wall 110*b*. The fixed scroll base plate 110*a* and the outer circumferential wall 110*c* form a compression housing 115. At the center of the fixed scroll base plate 110*a*, a discharge port 111, which connects with an oxygen electrode of the fuel cell, is formed.

A water jacket 112, which is a cooling means, is fixed to the fixed scroll base plate 110*a* by a bolt (not shown) so as to surround the discharge port 111. The water jacket 112 has a cooling fin inside thereof, thereby forming a cooling channel for flowing cooling water. The cooling water circulates between the water jacket 112, an external water pump and a radiator through an inlet and an outlet of the water jacket 112.

A movable scroll member 120 also has a disk-like movable scroll base plate 120*a* and a movable scroll spiral wall 120*b* that extends from the movable scroll base plate 120*a*. At the center of the movable scroll base plate 120*a*, a cylindrical crankshaft receiving portion 120*c* having a bottom is formed. On the outer circumferential side of the crankshaft receiving portion 120*c*, three cylindrical crankshaft receiving portions 120*d* each having a bottom are formed at equal intervals.

Also, at the distal end of the fixed scroll spiral wall 110*b*, a groove 110*e* is formed. In the groove 110*e*, a tip seal 113 is occupied. In a similar manner, at the distal end of the movable scroll spiral wall 120*b*, a groove 120*e* is formed. In the groove 120*e*, a tip seal 123 is occupied. The tip seal 113 of the fixed scroll member 110 slides relative to the inner surface 120*h* of the movable scroll base plate 120*a* while the tip seal 123 of the movable scroll member 120 slides relative to the inner surface 110*h* of the fixed scroll base plate 110*a*. Thereby, airtightness of gas in a compression region C defined between the fixed scroll member 110 and the movable scroll member 120 is ensured.

The crank unit is constituted of a drive crank mechanism 140 and a driven crank mechanism 150. The drive crank mechanism 140 orbits the movable scroll member 120. The driven crank mechanism 150 prevents the movable scroll member 120 from rotating around an axis of the movable scroll member 120. The drive crank mechanism 140 is constituted of the crankshaft receiving portion 120*c*, a crankpin 131*a* of a drive crankshaft 131 and a roller bearing 137 into which grease is sealed for supporting the crankpin 131*a*. The crankpin 131 a is rotatably supported by the roller bearing 137, which is accommodated in the crankshaft receiving portion 120*c*.

Also, the driven crank mechanism 150 is constituted of the crankshaft receiving portion 120*d*, a crankpin 151*a* of a driven crankshaft 151 and a radial ball bearing 153 into which grease is sealed for supporting the crankpin 151*a*. The crankpin 151*a* is rotatably supported by a radial ball bearing 153, which is accommodated in the crankshaft receiving portion 120*d*. In addition, the drive crankshaft 131 is rotatably supported at the front side by a radial ball bearing 138 into which grease is sealed. The driven crankshaft 151 is rotatably supported at the rear side by a radial ball bearing 152 into which grease is sealed.

While the movable scroll member orbits, moment of inertia is generated. To cancel the moment, a balance weight 154 is fixed onto a flange surface 131*f* formed on a main shaft portion 131*b* of the drive crankshaft 131 by four bolts.

A balance weight 151*b* is formed on the driven crankshaft 151. Thereby, vibration caused by the orbital movement of the movable scroll member 120 is reduced. The crank unit is accommodated in a center housing 170. The center housing 170 is firmly fixed to the compression housing 115 by a plurality of bolts (which is not shown). Thereby, the center housing 170 and the compression housing 115 are integrated firmly.

The crank unit and a drive motor unit are divided by a support frame 171, which is at the rear end of the center housing 170. The ball bearings 138 and 152 are fitted in the support frame 171.

The drive motor unit is constituted of a drive motor 130 and a substantially cylindrical motor housing 190 having a bottom. The motor housing 190 surrounds the drive motor 130, thereby accommodating the drive motor 130.

The drive motor 130 is constituted of a drive shaft 131*c*, a rotor 133 and a stator 134. The drive shaft 131*c* extends along the central axis of the drive motor 130. The rotor 133 is fitted around the drive shaft 131*c*. The stator 134 is arranged at the outer circumferential side of the rotor 134 and is wound by a coil 135. That is, the drive motor 130 is an induction motor. The number of rotations of the drive motor 130 can be controlled by an inverter (which is not shown).

On the drive shaft 131*c*, trim weights 132*a* and 132*b* are mounted respectively on the front and rear sides of the rotor 133. Thereby, moment of inertia applied to the drive crankshaft 131 is balanced in the direction of an axis of the drive crankshaft 131, or in the direction which deflects the axis of the drive crankshaft 131. In the present preferred embodiment, the drive shaft 131*c* of the drive motor 130, the main shaft portion 131*b* of the drive crankshaft 131 and the crankpin 131*a* integrally constitute the drive crankshaft 131.

The drive shaft 131*c* of the drive crankshaft 131 is rotatably supported by a ball bearing 139 at the center of the bottom of the motor housing 190, or at the center of the rear end of the motor housing 190. In addition, the clearance between the drive shaft 131*c* and the center of the bottom of the motor housing 190 is sealed by a seal 136. The motor housing 190 is firmly fixed to the center housing 170 by a plurality of bolts at the inner side of the front end. Thereby, the motor housing 190 and the center housing 170 are rigidly integrated.

When electricity is supplied to the drive motor 130, the drive crankshaft 131 rotates. Thereby, the drive crankshaft 131 orbits the movable scroll member 120 through the drive crank mechanism 150. At this time, air is introduced into the compression region C defined between the fixed scroll member 110 and the movable scroll member 120 through an inlet (which is not shown). During the orbital movement of the movable scroll member 120, the introduced air is compressed in the compression region C and is discharged through the discharge port 111. Thus, the compressed air is supplied to the oxygen electrode of the fuel cell.

Substantially at the middle of the outer circumference of the motor housing 190, an annular recess 191, which is a cooling channel, is formed. In the annular recess 191, a plurality of discontinuous fins 192 are formed. On the outer circumferential surface on the front and rear sides of the annular recess 191, annular grooves 193 and 194 are formed, in which O-rings 163 and 164 are occupied, respectively.

Figure 2:
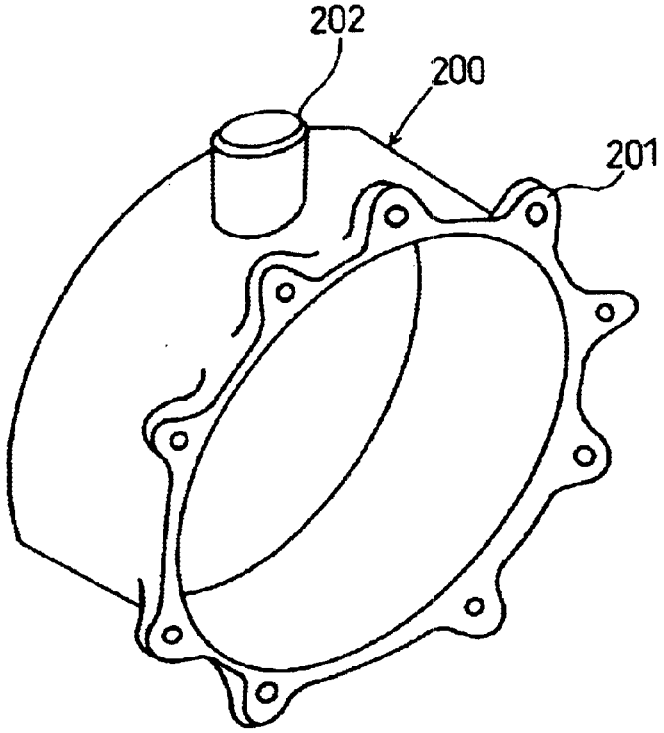
FIG. 2 is a perspective view illustrating an outer cylinder to the preferred embodiment of the present invention.

On the outer circumferential side of the motor housing 190, an outer cylinder 200 is mounted, which is shown in FIG. 2. The gap between the inner circumferential surface of the outer cylinder 200 and the outer circumferential surface of the motor housing 190 is sealed by O-rings 163 and 164 so as to have fluid-tightness. Thus, the annular recess 191 of the motor housing 190 and the outer cylinder 200, which closes the annular recess 191 so as to cover, form a water jacket 210 (or a cooling jacket) that is provided with a cooling channel 211 (or a refrigerant passage) having fluid-tightness. Cooling water flows into the water jacket 210 through an inlet 202 that protrudes from the outer cylinder 200. The cooling water passes through the space between the fins 192 in the cooling channel 211 and then flows outside of the motor housing 190 through an outlet (which is not shown). Thus, the drive motor 130 is efficiently cooled down by the water jacket 210. In the present preferred embodiment, the water jacket 112 that is provided on the scroll members and the water jacket 210 communicate through a channel (which is not shown). Thereby, a cooling system is constituted as a whole.

In the present preferred embodiment, nine flanges 201 protrude from the circumferential surface on the front side of the outer cylinder 200 in a radial direction at equal intervals in a circumferential direction. In a similar manner, nine flanges 173 protrude from the circumferential surface on the rear side of the center housing 170 in a radial direction at equal intervals in a circumferential direction. The nine flanges 201 and the nine flanges 173 are fixed to each other respectively by nine bolts 220. Thus, the outer cylinder 200 and the center housing 170 are firmly fixed. Thereby, the outer cylinder 200 and the center housing 170 are integrated. As described above, the center housing 170 and the motor housing 190 are integrated. As a result, the outer cylinder 200 is integrally and firmly fixed to the motor housing 190 through the center housing 170 or indirectly.

A measurement and an analysis

Now, the relation between a method for mounting the above outer cylinder on the motor housing, and vibration and noise of the compressor 100 is measured and analyzed with reference to FIG. 3 through FIG. 8. Note that in the above-preferred embodiment the outer cylinder 200 and the center housing 170 are fixed by the nine bolts 220 at nine points. For use in a following test compressor, however, the outer cylinder 200 and the center housing 170 are fixed by one bolt at one point or by four bolts at four points at equal intervals.

(1-1) An Analysis of vibration

Figure 3:
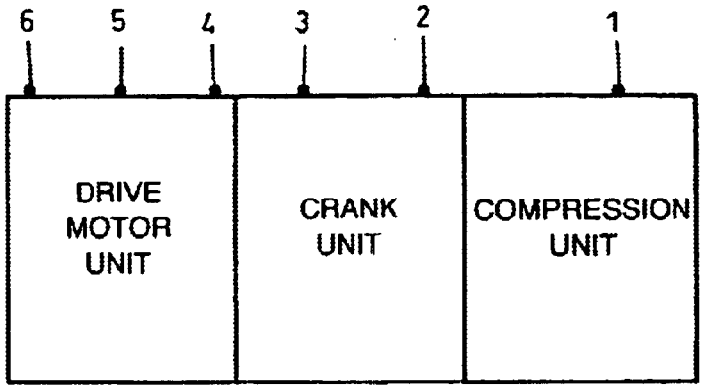
FIG. 3 is a schematic view illustrating positions for measuring vibration of the compressor.
Figure 4A:
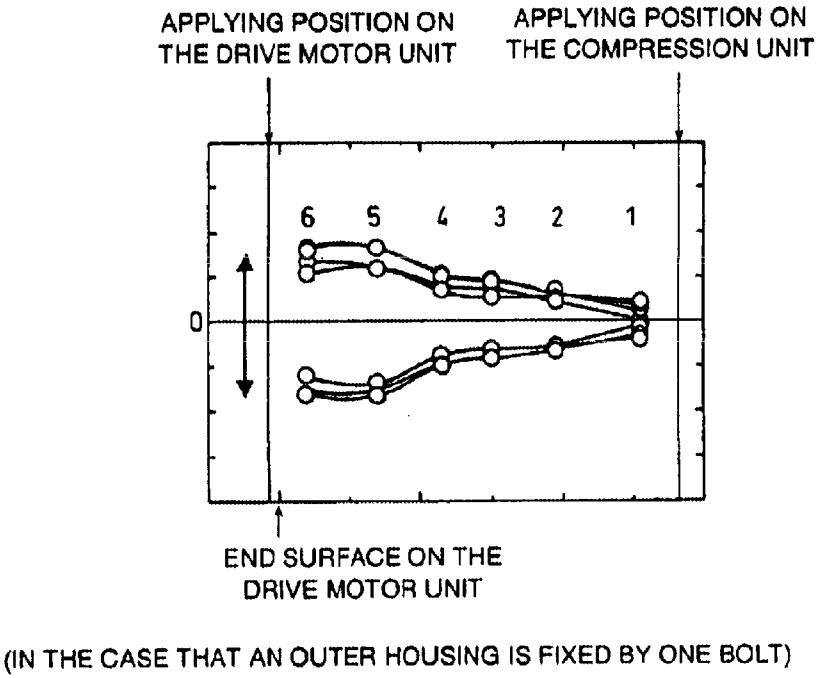
FIG. 4A is a view of vibrational mode of the compressor to measuring point in the case that the outer cylinder is fixed by one bolt.

As shown in FIG. 3, acceleration pickups are applied at measuring points 1 through 6 in the direction of an axis of the test compressor. Under a predetermined operational condition where the test compressor is driven at 5000 rpm (revolutions per minute) and the discharge pressure Pd and the suction pressure Ps are respectively 0.13 MPaG (mega pascal under gage pressure) and 0 MPaG, vibrational mode is measured and analyzed. In the case that the outer cylinder 200 and the center housing 170 are fixed by one bolt, variation of acceleration (or variation of amplitude) of the ninth rotational component is shown in FIG. 4A. In a similar manner, in the case that the outer cylinder 200 and the center housing 170 are fixed by four bolts, variation of acceleration (or variation of amplitude) of the ninth rotational component is shown in FIG. 4B.

Figure 4B:
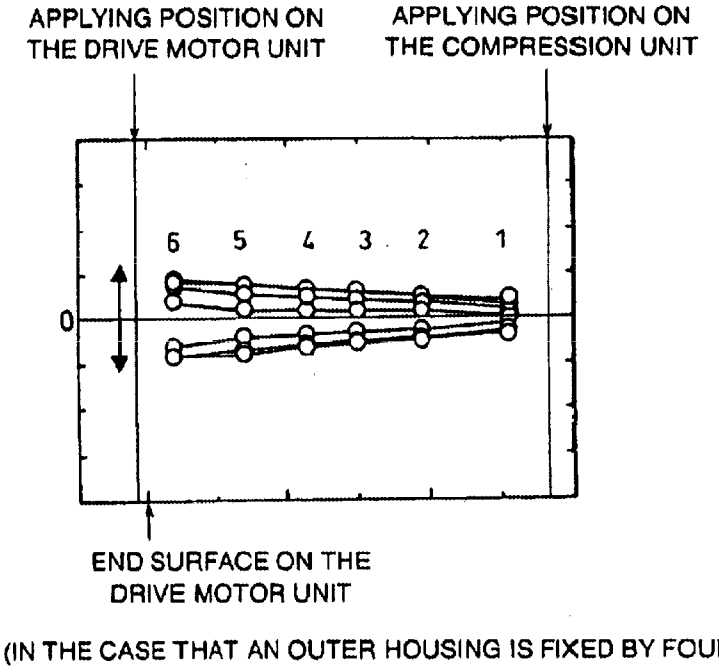
FIG. 4B is a view of vibrational mode of the compressor to measuring point in the case that the outer cylinder is fixed by four bolts.

Note that in FIGS. 4A and 4B the measuring points that are linked by identical lines indicate results of a measurement at the identical time (or the identical phase) at the respective measuring points. In FIGS. 4A and 4B, there is a plurality of lines that are linked by the measuring points. This is because a plurality of results of the measurement at the time of measurement at equal intervals is partially layered. In a similar manner, this is also employed in FIGS. 6A, 6B, 7A and 7B.

As shown in FIGS. 4A and 4B, as the number of bolts that are fixed increases, vibration of the drive motor 130 is prominently reduced. Thereby, vibration of the test compressor is also reduced as a whole. When the four bolts are applied to the test compressor, it is confirmed that the test compressor vibrations as if a rigid body vibrations.

(1-2) An analysis of vibration

Figure 5:
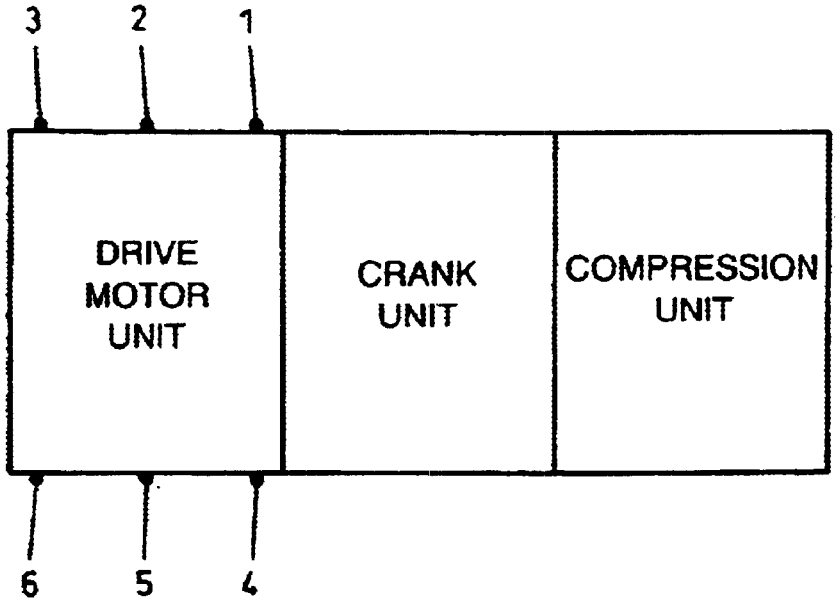
FIG. 5 is a schematic view illustrating positions for measuring vibration of a drive motor unit.
Figure 6A:
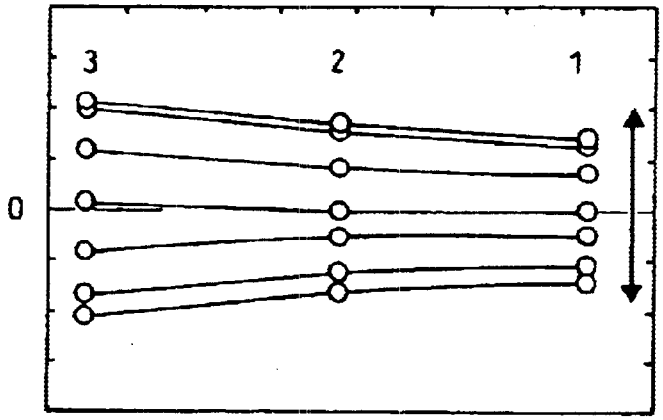
FIG. 6A is a view of vibrational mode of the drive motor unit to measuring point in the case that the outer cylinder is fixed by one bolt.
Figure 6B:
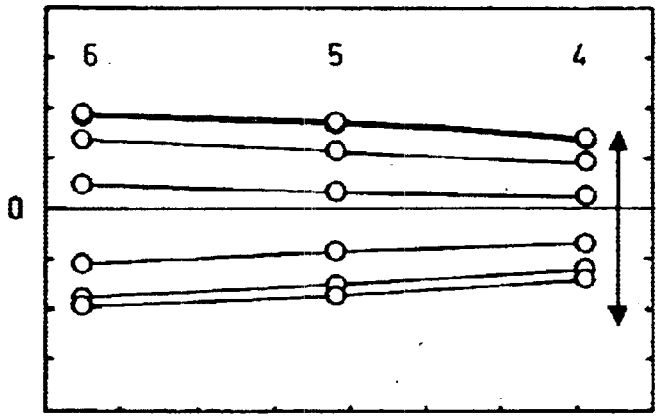
FIG. 6B is also a view of vibrational mode of the drive motor unit to measuring point in the case that the outer cylinder is fixed by one bolt.
Figure 7A:
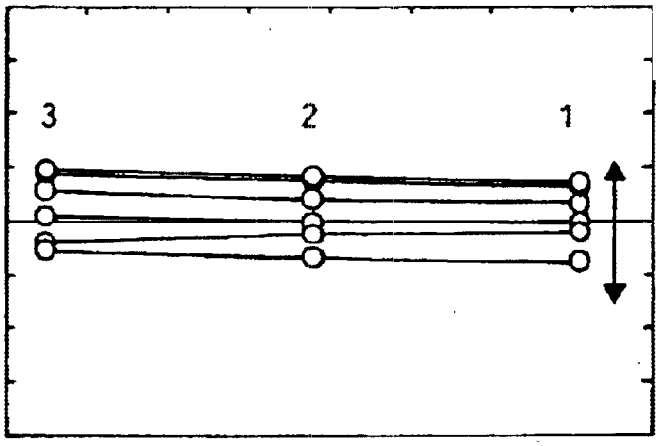
FIG. 7A is a view of vibrational mode of the drive motor unit to measuring point in the case that the outer cylinder is fixed by four bolts.
Figure 7B:
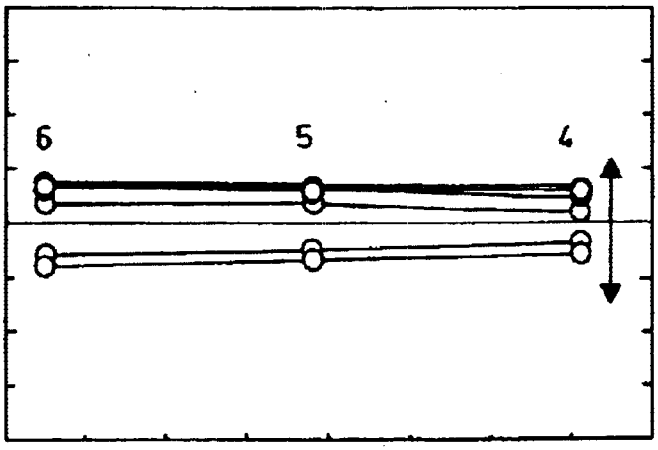
FIG. 7B is also a view of vibrational mode of the drive motor unit to measuring point in the case that the outer cylinder is fixed by four bolts.

As shown in FIG. 5, three acceleration pickups are applied to the upside and the downside of the drive motor on respective side at measuring points 1 through 6. Under a predetermined operational condition where the test compressor is driven at 5000 rpm and the discharge pressure Pd and the suction pressure Ps are respectively 0.13 MPaG and 0 MPaG, vibrational mode is measured and analyzed. In the case that the outer cylinder and the center housing are fixed by one bolt, variation of acceleration (or variation of amplitude) of the ninth rotational component is shown in FIGS. 6A and 6B. In a similar manner, in the case that the outer cylinder and the center housing are fixed by four bolts, variation of acceleration (or variation of amplitude) of the ninth rotational component is shown in FIGS. 7A and 7B.

In a similar manner, as shown in FIGS. 6A, 6B, 7A and 7B, as the number of bolts that are fixed increases, it is confirmed that vibration of the drive motor is substantially isotropically prominently reduced.

(2) An analysis of noise

Figure 8A:
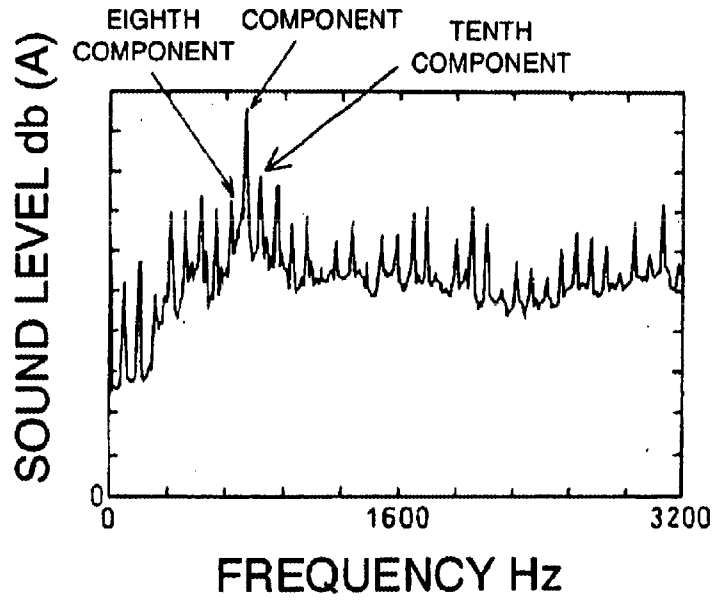
FIG. 8A is a view illustrating a sound level of a test compressor to frequency in the case that the outer cylinder is fixed by one bolt.
Figure 8B:
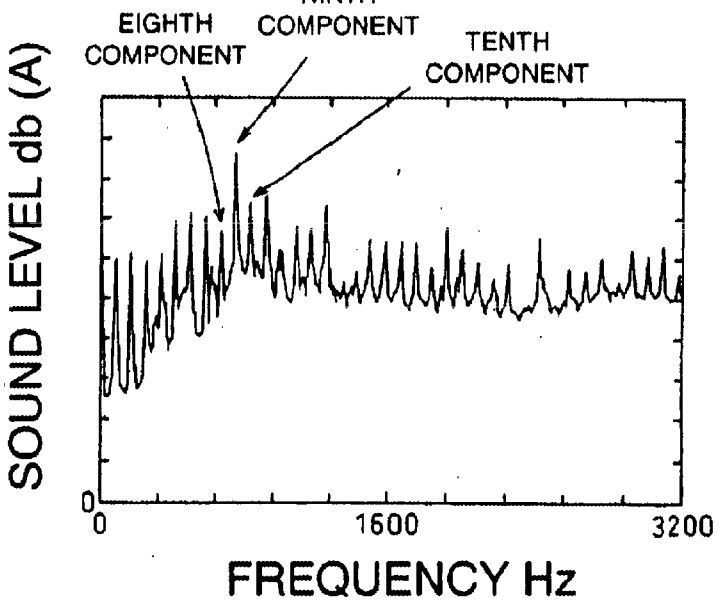
FIG. 8B is a view illustrating a sound level of a test compressor to frequency in the case that the outer cylinder is fixed by four bolts.

In the cases that the outer cylinder and the center housing are fixed by one bolt and by four bolts, respectively under a predetermined operational condition where the test compressor is driven at 5000 rpm and the discharge pressure Pd and the suction pressure Ps are respectively 0.13 MPaG and 0 MPaG, sound level is measured. FIGS. 8A and 8B show the respective results.

As shown in FIGS. 8A and 8B, it is read that the sound level of the eighth component through tenth component in the vicinity of resonance frequency considerably decreases as the number of bolts that are fixed to the outer cylinder increases. In the present test, for example, the noise of the eighth component, the ninth component and the tenth component decreases respectively by 6.4 dB (or decibel), 6.1 dB and 4.9 dB.

As described above, it is obvious that vibration and noise arisen in the scroll type compressor can be considerably reduced as the plurality of bolts is used for fixing the outer cylinder.

According to the above-preferred embodiment of the present invention, the cooling jacket for cooling the drive motor of the compressor can be constituted simply. In addition, vibration and noise of the compressor can be reduced and prevented.

In the present invention, the following embodiments are also practiced.

In the above-preferred embodiment, the outer cylinder is indirectly fixed to the motor housing through the center housing. However, the outer cylinder may be indirectly fixed to the motor housing through one of the compression housing, a housing for mounting the compressor and a stay for mounting the compressor. In any case, the compression housing, the housing and the stay to which the outer cylinder is fixed are required to integrally or rigidly firmly fix to the motor housing or to integrally or rigidly firmly connect with the motor housing such that the outer cylinder and the motor housing integrally or rigidly vibrate. Also, the outer cylinder may be directly fixed to the motor housing by a bolt or a plurality of bolts or by press-fit.

In the above-preferred embodiment, when the outer cylinder is fixed by the bolts, the bolts are arranged so as to extend in the axial direction. However, the bolts may be arranged so as to extend in the radial direction. When the bolts are arranged in the axial direction parallel with each other, the outer cylinder is easily fixed by the bolts through the flanges that protrude in the radial direction.

In the above-preferred embodiment, nine bolts are employed. Also, when vibration and noise are measured and analyzed, the outer cylinder and the motor housing are fixed by one bolt and by four bolts for the sake of convenience. However, it is considered that the vibration and noise can be further reduced as the number of bolts that are fixed to the outer cylinder and the motor housing increases. In the above-preferred embodiment, at least two bolts are required. More preferably, the outer cylinder is fixed at upside, downside, right side and left side by four bolts. In addition, when five through nine bolts are arranged around the outer cylinder at equal intervals, the outer cylinder is relatively firmly fixed. Excess bolts are not preferable because of increase of the number of the parts and time and process for installing the parts.

In the above-preferred embodiment, it is not limited to a bolt or a plurality of bolts for fixing the outer cylinder and the motor housing. In a similar manner, the outer cylinder and the motor housing may be fixed by press-fitting. This is because it is considered that the case that is fixed by press-fit corresponds to the case that is fixed by illimitably increased numbers of bolts.

Also, a position of the press-fit or positions of the press-fit are not limited. For example, the outer cylinder may be press-fitted at the both ends, at an either end or at the middle. Since the inner circumferential surface of the outer cylinder may be a surface for sealing cooling water, the inner circumferential surface of the outer cylinder may be used for press-fit. Note that when an O-ring is employed as a seal, it may be hard to press-fit. In this case, liquid packing may be used. Also, in the case that the O-ring is employed so as to easily assemble and disassemble the outer cylinder, a surface for press-fit may be employed except the surface for sealing.

A margin for press-fit may be adjusted by varying the outside diameter of the outer cylinder. The margin for press-fit may also be adjusted by varying the inside diameter of the outer cylinder. In any case, an appropriate margin is required in consideration of the variation of the temperature and the vibration during the running of the compressor.

The refrigerant passage in the cooling jacket may be formed in various manners. In the above-preferred embodiment, the refrigerant passage is formed by closing a recess formed on the outer circumferential side of the motor housing with the outer cylinder. Such a recess may be formed on the inner circumferential side of the outer cylinder. Furthermore, such a recess may be formed on the inner and outer circumferential sides of the outer cylinder. Actually the refrigerant passage is easily formed when the recess is formed on the outer circumferential side of the motor housing. More preferably, to improve heat transfer between the motor housing and refrigerant, a cooling fin and a recess may be formed on the outer circumferential side of the motor housing. Thereby, contact area between the motor housing and refrigerant is increased.

As for the refrigerant in the refrigerant passage, water or cooling water is generally employed in view of its cooling performance and its handleability. When cooling water is used as a refrigerant in the refrigerant passage, the refrigerant passage is a cooling channel and the cooling jacket is a water jacket. However, the refrigerant is not limited to water. Oil, gas such as air, oxygen and hydrogen, and fuel such as gasoline and light oil may be employed.

In the above-preferred embodiment, the scroll type compressor is employed as an example. This is because the scroll type compressor is not only compact and effective to compress fluid but also has less vibration and noise. However, other types of compressors also generate similar vibration and noise as long as the compressor has a compression cycle of suction, compression and discharge. For example, a screw type compressor (or a lysholm type compressor) and a piston type compressor may be employed in place of the scroll type compressor. Although the arisen level and the reduced component of the vibration and noise vary in connection with a type of machine and a driving state, it is considered that a total tendency or a macro tendency does not change.

Furthermore, in a scroll type compressor for use in a fuel cell system, vibration and noise are effectively reduced. As for the fuel cell system, for example, an alkaline water solution type, a solid macromolecule type, a phosphoric acid type, a fused carbonate type and a solid electrolyte type may be employed.

Also, in the above-preferred embodiment, air is employed as a fluid in the compression region. However, the refrigerant is not limited to gas. Fluid that includes liquid may be employed as a fluid.

The present examples and preferred embodiments are to be considered as illustrative and not restrictive, and the invention is not to be limited to the details given herein but may be modified within the scope of the appended claims.

What is claimed is:

1. A compressor comprising:

a compression unit for compressing introduced fluid;

a drive motor for driving the compression unit;

a motor housing for surrounding the drive motor;

a center housing fixed to the motor housing;

an outer cylinder mounted on an outer circumferential side of the motor housing, the outer cylinder being directly fixed to the center housing, wherein the outer cylinder is indirectly fixed to the motor housing by press-fitting;

an annular groove formed on the outer circumferential surface of the motor housing:

an O-ring occupying the annula groove; and a cooling jacket defined between the motor housing and the outer cylinder for cooling the drive motor by a fluid flowing in the cooling jacket, the cooling jacket being sealed by the O-ring.

2. The compressor according to claim 1, wherein the motor housing has a plurality of fins on the outer circumferential side in the cooling jacket for radiating heat.

3. The compressor according to claim 1, wherein the cooling jacket is sealed by two O-rings.

4. The compressor according to claim 1, wherein the fluid is air.

5. The compressor according to claim 1, wherein the outer circumferential side of the motor housing has a recess and the cooling jacket is constituted of a fluid passage defined by closing the recess with the outer cylinder.

6. The compressor according to claim 5, wherein the fluid is water.

7. The compressor according to claim 1, wherein the compression unit includes a fixed scroll member and a movable scroll member that face to each other, the fixed scroll member having a fixed scroll base plate and a fixed scroll spiral wall that extends from the fixed scroll base plate, the movable scroll member having a movable scroll base plate and a movable scroll spiral wall that extends from the movable scroll base plate, the movable scroll member being rotated with respect to the fixed scroll member by the drive motor unit.

8. The compressor according to claim 7, wherein the compressor is a scroll type compressor or supplying an electrode of a fuel cell with the fluid compressed in a compression region defined between the fixed scroll member and the movable scroll member.

9. The compressor according to claim 8, wherein the fuel cell is one of an alkaline water solution type, a solid macromolecule type, a phosphoric acid type, a fused carbonate type and a solid electrolyte type.

10. The compressor according to claim 1, wherein the number from four through nine of bolts is employed.

11. The compressor according to claim 10, wherein the number of bolts is four.

12. The compressor according to claim 10, wherein the number of bolts is nine.

13. A scroll type compressor comprising:

a motor housing having an outer circumferential side on which two annular grooves are formed;

two O-rings, each occupying a respective one of the annular grooves;

a drive motor surrounded by the motor housing;

a center housing having a flange on an end surface, the center housing being fixed to the motor housing;

a fixed scroll member fixed to the center housing;

a movable scroll member placed between the center housing and the fixed scroll member, the movable scroll member engaging with the fixed scroll member, the movable scroll member being driven by the drive motor for compressing fluid between the fixed scroll member and the movable scroll member;

an outer cylinder having a cylindrical shape and a flange on an end surface, the outer cylinder being mounted on the outer circumferential side of the motor housing, the outer cylinder being directly fixed to the center housing by fastening the flange of the outer cylinder to the flange of the center housing with a plurality of bolts, the outer cylinder being indirectly fixed to the motor housing through the O-rings by press-fitting; and a cooling jacket defined between the outer cylinder and the motor housing for cooling the drive motor by refrigerant flowing in the cooling jacket, the cooling jacket being sealed by the O-rings.

14. The scroll type compressor according to claim 13, wherein the motor housing has a plurality of fins on the outer circumferential side in the cooling jacket for radiating heat.

15. The scroll type compressor according to claim 13, wherein the number from four through nine of bolts is employed.

16. The scroll type compressor according to claim 13, wherein the fluid is air.

17. The scroll type compressor according to claim 13, wherein the outer circumferential side of the motor housing has a recess and the cooling jacket is constituted of a refrigerant passage defined by closing the recess with the outer cylinder.

18. The scroll type compressor according to claim 17, wherein the refrigerant is water.

* * * * *

UNITED STATES PATENT AND TRADEMARK OFFICE

CERTIFICATE OF CORRECTION

PATENT NO. : 6,692,205 B2
DATED : February 17, 2004
INVENTOR(S) : Takahiro Moroi et al.

It is certified that error appears in the above-identified patent and that said Letters Patent is hereby corrected as shown below:

Column 10,
Line 7, please delete "compressor or" and insert therefor -- compressor for --

Signed and Sealed this

First Day of June, 2004

JON W. DUDAS
*Acting Director of the United States Patent and Trademark Office*